United States Patent [19]

Redford

[11] Patent Number: 5,031,982

[45] Date of Patent: Jul. 16, 1991

[54] FLEXIBLE PAYOUT DUCT

[75] Inventor: Gary R. Redford, Tucson, Ariz.

[73] Assignee: Hughes Aircraft Company, Los Angeles, Calif.

[21] Appl. No.: 527,619

[22] Filed: May 23, 1990

[51] Int. Cl.[5] ..... G02B 6/44

[52] U.S. Cl. ..... 350/96.10; 206/409; 242/1; 242/128; 242/157 R; 242/171; 267/179; 350/96.29

[58] Field of Search ..... 350/96.10, 96.20, 96.29, 350/96.30; 267/166–180; 57/59, 62, 63; 206/408, 409; 242/1, 4 R, 18 R, 27, 234, 309, 125, 128, 157 R, 170, 171; 250/227.11

[56] References Cited

U.S. PATENT DOCUMENTS

| | | | |
|---|---|---|---|
| 3,449,199 | 6/1969 | Mead | 267/166 X |
| 3,862,751 | 1/1975 | Schwaller | 267/179 X |
| 4,496,213 | 1/1985 | Borsuk | 350/96.22 |
| 4,763,647 | 8/1988 | Gambale | 128/657 |
| 4,889,295 | 12/1989 | McMoore, Jr. et al. | 242/1 X |
| 4,935,620 | 6/1990 | Schotter et al. | 250/227.11 |
| 4,950,049 | 8/1990 | Darsey et al. | 350/96.30 |

*Primary Examiner*—John D. Lee

*Attorney, Agent, or Firm*—C. D. Brown; R. M. Heald; W. K. Denson-Low

[57] ABSTRACT

A filament (36) of a material having resilient springlike characteristics is helically wound to form a hollow tubular guide (34) for an optical fiber (14) dispensed from a wound stack (37). The guide can have a constant diameter (34) or, alternatively, include portions of a different diameter (44, 50, 52). A further embodiment especially advantageous for use in a helicopter (10) positions a rigid tube (58) around the guide (56) leaving a portion of the guide extending from the rigid tube.

12 Claims, 2 Drawing Sheets

FLEXIBLE PAYOUT DUCT

BACKGROUND OF THE INVENTION

1. Field of the Invention

The present invention relates generally to an optical fiber payout dispenser, and, more particularly, to a flexible fiber payout duct for use with such a dispenser.

2. Description of the Related Art

Certain missiles utilize a quantity of an optical fiber which is dispensed upon launch to maintain a data link between the launch site and the missile throughout all or a portion of the flight. The dispenser at the missile, and also frequently at the launch site, consists of a wound fiber coil or stack which is unwound as the missile moves away from the missile launch site. The optical fiber at all times during its use must be protected from bending, kinking or undue stressing which can result in either damage or destruction of the fiber, or reduction of light signal communication efficiency along the fiber.

In some cases, it is necessary to guide the fiber upon dispense along a path to avoid the missile propulsion gases which can quickly destroy an unprotected fiber. In other cases, it may be necessary to provide safe change in the dispensing direction as in the case of a helicopter, for example, which changes its flight direction after missile launch. One approach to this problem is to provide a smooth inner surface pipe or tubing of appropriate configuration to move the dispensed fiber in the required direction. Since the fiber is being dispensed at a very high rate of speed, redirecting or ducting from a rigid tubing is not completely satisfactory in that it can damage the fiber in one or several of the ways already indicated. Also, even if it were satisfactory where a fixed change in direction is required, it still may not be satisfactory for use in dispensing from a helicopter where there could be a substantial and sudden change in direction of unknown magnitude and direction.

It is therefore desirable to be able to provide ducting of an optical fiber being dispensed which is sufficiently variable to accommodate a relatively rapid change in dispensing direction over a substantial solid angle without damaging the fiber or impairing optical signal transmission efficiency.

SUMMARY OF THE INVENTION

In accordance with a first embodiment of the present invention, a flexible duct through which a dispensed optical fiber passes upon missile launch is formed by helically winding a filament such as a spring wire forming an elongated tube-like member of substantially constant inner diameter significantly greater than the fiber diameter. The duct is flexible in being capable of bending transversely of the fiber longitudinal axis by virtue of the spring wire construction. In use, the duct may be specifically formed and secured into any curved pattern required for a particular ducting requirement. The fiber is then threaded through the duct from one end to the other and wound onto the dispensers at the missile and at the launch site. Alternatively, the flexible duct may be left unrestrained so as to bend during fiber dispense changing the dispensing direction.

A second embodiment includes a length of a tubular flexible duct formed in the same manner as in the first described embodiment having constant crosssectional dimensions. Onto an end portion of the constant cross-section part, there is provided a conical tubular member formed from spring wire and helically wound as in the first part. The enlarged open end of the conical part faces the dispenser and receives the dispensed fiber funneling it down to the smaller diameter portion from which it exits along a ducted path. As before, the duct may be formed over a wide range of desired angles or directions to lead the dispensed fiber according to some predetermined requirement.

In a still further version of the invention, a constant cross-sectional length of hollow tubular element is formed by helically winding a spring wire as in the first two described versions and then a tapering portion is formed by the same wire helically wound with adjacent loops having an increasingly larger diameter following which there is a further tubular portion formed by helically winding the wire into a constant diameter portion substantially larger than that of the first constant diameter portion.

In yet another version, the flexible duct is constructed in accordance with the first described version and has an additional portion enclosed within a reinforcing tube to damp flexibility along a part of the duct which can be advantageously used within a helicopter.

DESCRIPTION OF PREFERRED EMBODIMENTS

Figure 1:
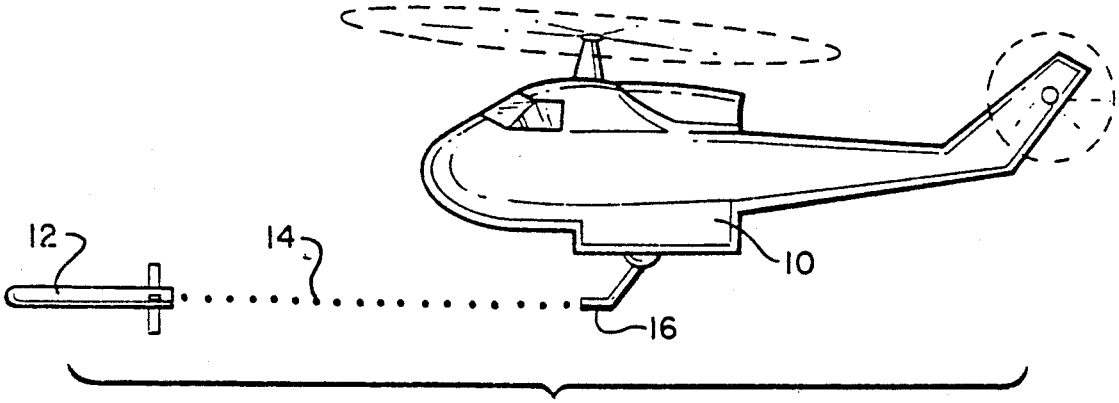
FIG. 1 is a schematic view of a helicopter shown launching a missile and a flexible duct of the present invention being used.

With reference now to the drawings and particularly FIG. 1, there is shown a helicopter 10 to which a launched missile 12 is interconnected via an optical fiber data link 14 being dispensed through a duct 16 from the helicopter. Since it is not unusual for a helicopter to change its flight direction shortly after missile launch, it is important that the duct 16 be capable of accommodating this change in direction without subjecting the optical fiber 14 to undue flexing. Accordingly, one of the embodiments of a flexible duct described herein will be shown to be particularly advantageous for use on a helicopter.

Figure 2:
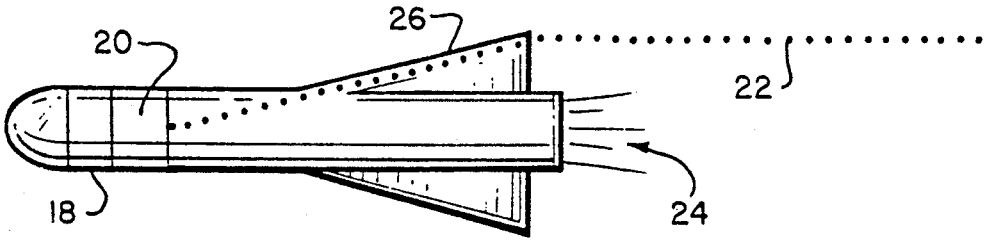
FIG. 2 shows use of a flexible duct of the present invention to duct dispensing fiber out of the path of rocket motor propulsion gases.

FIG. 2 shows a missile 18 in flight with a wound dispenser 20 centrally located on the missile for dispensing an optical fiber data link 22 along such a path that the optical fiber will not have to pass through the rocket motor propulsion gases 24. As shown, the optical fiber 22 passes through a duct 26 which guides the fiber to a radially offset position for dispensing at a point remote from the propulsion gases. Clearly, an optical fiber which is unwinding at the normally expected high rate of speed from the dispenser 20 and has to change its path direction to the offset position shown in FIG. 2, must not move the fiber along too sharply a curved path in order not to injure the fiber or reduce the light transmission efficiency of the data link.

Figure 3:
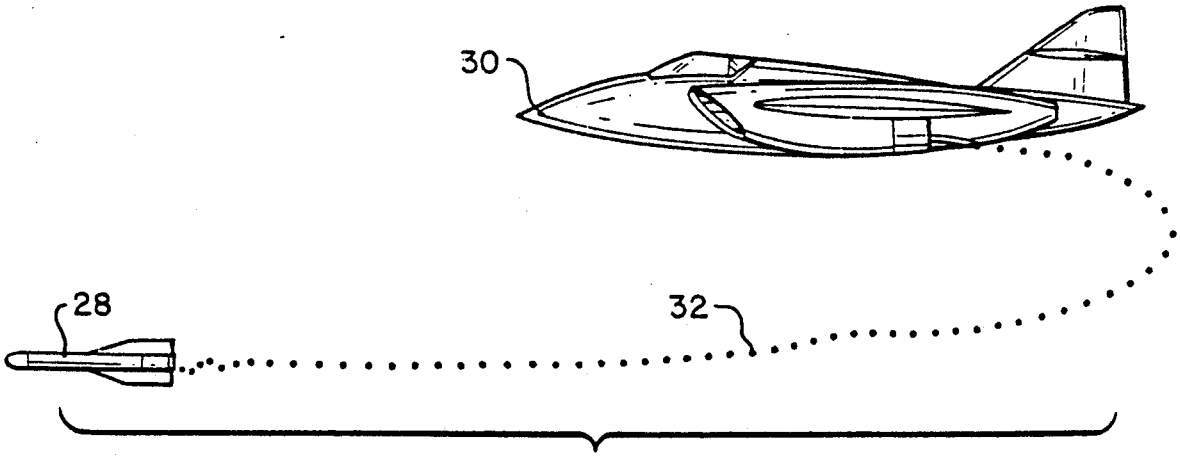
FIG. 3 shows dispensing from an aircraft.

FIG. 3 shows launch of a missile 28 from a moving aircraft 30 which, in the usual case, because air movement has the optical fiber 32 trailing both rearwardly of the aircraft as well as rearwardly of the missile. In both cases, that is from the missile and from the aircraft, dispensing may require ducting in order to maintain a sufficiently large bend radius to avoid damaging the optical fiber or interfering with the transmitted light signal.

Figure 4:
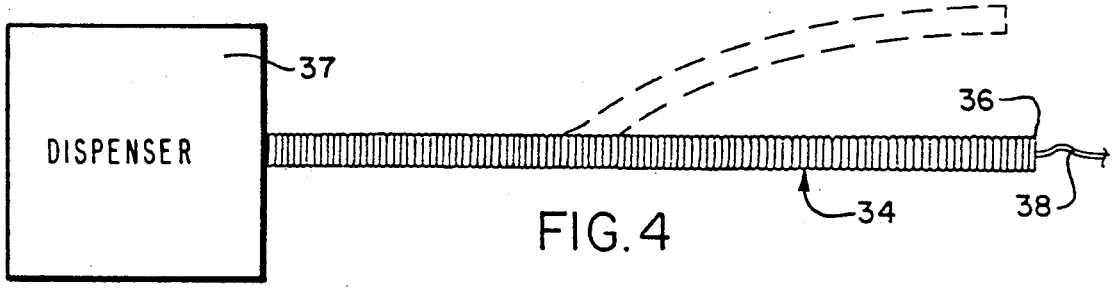
FIG. 4 is a side elevational view of a first version of the invention.
Figure 8:
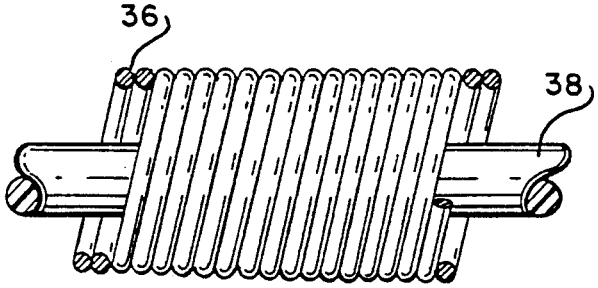
FIG. 8 is an enlarged, partially fragmentary sectional view of a fiber passing along the interior of a flexible duct.

For a detailed description of a first embodiment of the invention, reference is now made to FIG. 4. As shown there, the optical fiber duct 34 is constructed of a filament such as a length of spring wire 36 formed into a helically wound, hollow tube both ends of which are open. One end of the duct is interconnected with a dispenser 37 (shown in schematic representation only) for receiving the optical fiber 38 and dispensing along the tube to exit from the duct opposite end. FIG. 8 shows an enlarged view with the wound wire form defining the flexible duct.

Although duct 34 is shown extended in a straight line, by virtue of the flexibility of the wire forming the duct, it can be curved or turned in any variety of different positions (dashed line) in order to lead the fiber along a predetermined path. Of course, in the general situation, the curved nature of the duct is going to be confined to relatively large curvatures in order to prevent kinking or overstressing of the fiber during dispensing. It is also important that the wire composing the duct have a smooth inner surface which may be enhanced by the addition of a lubricant, if desired.

Figure 5:
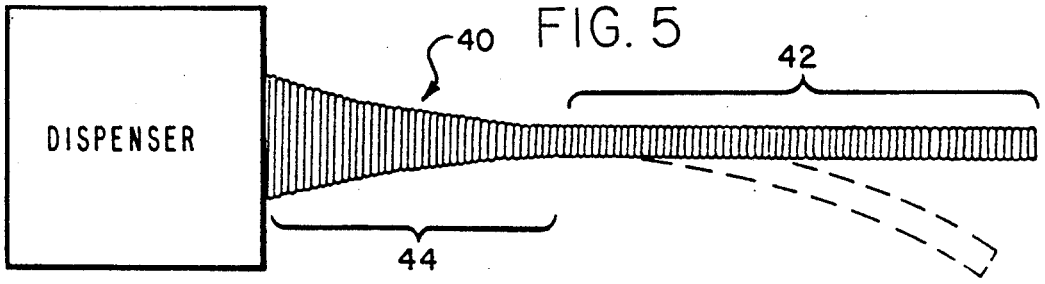
FIG. 5 is a further embodiment of the present invention.

FIG. 5 depicts another embodiment which will be advantageous in reducing the helix of the dispensed fiber. On occasion, due to a number of factors which cannot readily be foreseen, the dispensed fiber may develop an excessively large helix which can result in damage to or breakage of the fiber. The duct 40 has a portion 42 of constant cross-sectional dimensions formed in the same manner as the first described embodiment from helically wound spring wire. The end of the portion which is to receive the dispensed fiber is formed into an expanding cone 44 by helically winding the wire with the loops becoming progressively larger in diameter. The cone 44 has a sufficiently large crossectional opening for receiving the dispensed fiber and not damaging it even if a relatively large helix is formed on dispense. As the fiber moves along the cone 44 and into the constant cross-section portion 42 the fiber is damped substantially. Also, although depicted as ducting along a straight line path, the duct construction permits flexing to a wide range of configurations, one of which is shown in dashed line.

Figure 6:
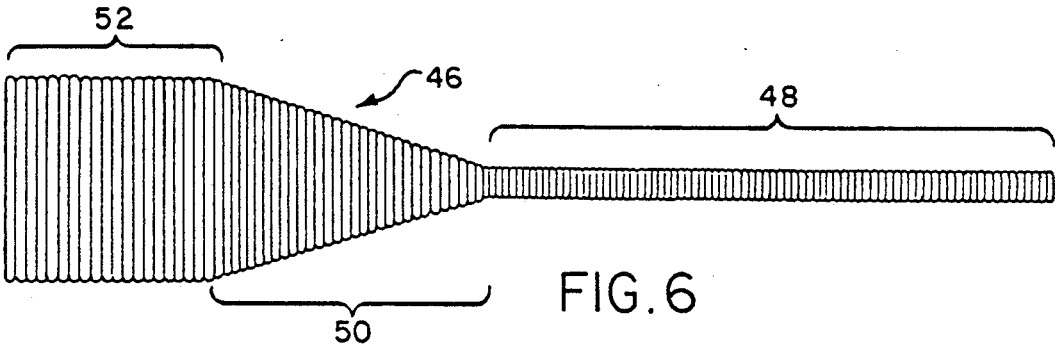
FIG. 6 is a still further embodiment of the flexible duct of this invention.

A still further version of the invention is that depicted in FIG. 6. This duct 46 includes a constant cross-section portion 48 and expanding cone portion 50 which can be wound from spring wire in the same manner as the FIG. 5 embodiment. In addition, there is a further constant cross-section portion 52 dimensionally substantially identical to the large end of the expanding cone portion. This construction not only provides fiber helix damping of different characteristics from the FIG. 5 version, but also provides a duct having different flexibility in its different parts.

Figure 7:
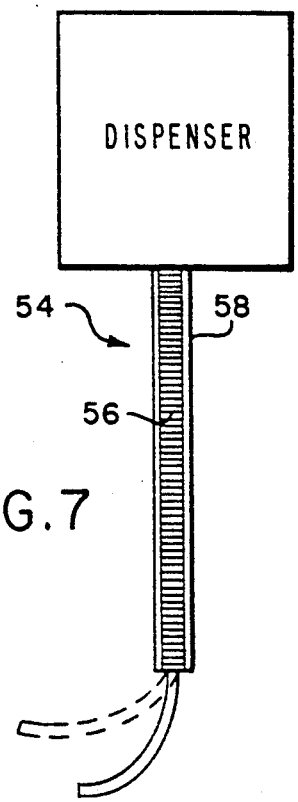
FIG. 7 is a side elevational, partially sectional view of a flexible duct which is damped for use in a helicopter.

In certain mounting arrangements for a duct, it may be advisable or necessary to have a part of the duct reinforced against flexing. As seen in FIG. 7, the duct 54 has a first spring wire wound portion 56 of constant cross-section positioned within an open-ended rigid tube 58. A wire wound portion 60 of lesser cross-sectional dimension than the first portion 56 is continuous with 56 and extends outwardly of the tube 58. This version is especially advantageous for use in a helicopter where the craft is frequently maneuvered to a new course heading immediately after launching of the missile.

The described ducting devices can all be advantageously employed for leading an optical fiber, as it unwinds from a dispenser, along a predetermined path which may include one or more curved portions. This ducting of the fiber is accomplished without undue flexing of the fiber that could otherwise either damage the fiber or impair light signal transmission along the fiber.

Although the present invention is described in connection with preferred embodiments, it is to be understood that one skilled in the appertaining art may be able to make modifications that come within the spirit of the invention and are covered by the appended claims. For example, although the invention has been particularly described in connection with ducts made of spring metal wire, it is contemplated that the ducts can alternatively be formed from filaments constructed of a number of different synthetic plastics (or coated with the plastics) presenting a smooth surface to an optical fiber moving through the duct (e.g., Teflon).

What is claimed is:

1. A multi-directional duct for guiding an optical fiber during payout from a dispenser assembly, comprising:

a continuous length of springlike filament material forming an elongated helical coil with an opening extending throughout, wherein the optical fiber passes through the coil during payout;

said coil including a first end portion fixedly attached to said dispenser assembly and a second end portion free-to-move relative to said dispenser assembly to accommodate changes in direction of the payout fiber without damaging the fiber or impairing optical signal transmission throughout the fiber.

2. A duct as in claim 1, in which the coil is one filament width thick.

3. A duct as in claim 1, in which the filament is constructed of steel.

4. A duct as in claim 1, in which the filament is constructed of a synthetic plastic.

5. A duct as in claim 1, in which the first end portion of the coil has a first diameter and the second end portion has a second diameter differing from the first diameter.

6. A duct as in claim 1, in which the coil is resiliently responsive to forces applied transversely of the coil axis.

7. A duct as in claim 1, in which the coil has a circular cross-section.

8. A duct as in claim 1, in which a rigid tube encloses at least a portion of said elongated helical coil to dampen unwanted movement of said coil during fiber payout.

9. A multi-directional device for guiding an optical fiber payout from a wound fiber stack assembly, comprising:

a springlike wire forming a helically wound tube having an opening sufficient for the fiber to pass through said tube during payout, said tube including a first end portion fixedly attached to the stack assembly and a second end portion having a generally constant diameter and free-to-move relative to the stack assembly to accommodate changes in direction of the payout fiber.

10. A device as in claim 9, in which the major length of the hollow helically wound tube is enclosed within a further rigid tube and a portion of the hollow tube extends outwardly of the rigid tube.

11. A device as in claim 9, in which the first end portion includes a conically-shaped cross-section and the first and second end portions are formed from a single wire.

12. A device as in claim 11, in which the first end portion further includes a generally cylindrical portion having an internal diameter substantially the same as a largest internal diameter of said conically-shaped portion.

* * * * *